US006602528B1

(12) United States Patent
Wells

(10) Patent No.: US 6,602,528 B1
(45) Date of Patent: Aug. 5, 2003

(54) FOOD PACKAGING DEVICE FOR MULTILAYER FOOD ITEMS IN SEPARATE LAYERS

(76) Inventor: Peter Wells, PO Box 2270, Dandenong North, VIC. 3175 (AU)

( * ) Notice: Subject to any disclaimer, the term of this patent is extended or adjusted under 35 U.S.C. 154(b) by 0 days.

(21) Appl. No.: 09/554,696

(22) PCT Filed: Nov. 19, 1998

(86) PCT No.: PCT/AU98/00965

§ 371 (c)(1),
(2), (4) Date: May 18, 2000

(87) PCT Pub. No.: WO99/26863

PCT Pub. Date: Jun. 3, 1999

(30) Foreign Application Priority Data

Nov. 19, 1997 (AU) ..... PP0445

(51) Int. Cl.[7] ..... B65D 81/32; B65D 25/08

(52) U.S. Cl. ..... 426/120; 426/119; 426/124; 426/115; 426/394; 229/120.06; 229/120.32; 229/120.33; 229/120.34; 229/902; 229/904; 229/938; 220/529

(58) Field of Search ..... 426/119, 120, 426/128, 129, 115, 394, 124; 229/902, 904, 120.06, 120.07, 120.32, 120.24, 120.25, 938, 101, 120.33, 120.34; 206/561, 499; 220/529, 554

(56) References Cited

U.S. PATENT DOCUMENTS

| | | | | | |
|---|---|---|---|---|---|
| 981,744 | A | * | 1/1911 | Bowditch | 229/120.32 |
| 1,706,334 | A | * | 3/1929 | Toch | 206/219 |
| 2,510,211 | A | * | 6/1950 | Clearly | 229/120.32 |
| 2,852,177 | A | * | 9/1958 | Frasch | 229/120.32 |
| 3,586,206 | A | * | 6/1971 | Gilmore et al. | 221/89 |
| 4,137,333 | A | * | 1/1979 | Daswick | 426/120 |
| 4,154,860 | A | * | 5/1979 | Daswick | 426/412 |
| 4,844,330 | A | * | 7/1989 | Roosa et al. | 229/120.06 |
| 4,951,866 | A | * | 8/1990 | Rusnak | 229/120.07 |
| 5,012,971 | A | * | 5/1991 | Cozzi et al. | 229/120.07 |
| 5,039,003 | A | * | 8/1991 | Gordon et al. | 229/120.32 |
| 5,213,256 | A | * | 5/1993 | Cyr | 229/120.32 |

FOREIGN PATENT DOCUMENTS

| | | | | |
|---|---|---|---|---|
| GB | 2285791 | A | * | 7/1995 |
| JP | 401132332 | A | * | 5/1989 |

* cited by examiner

*Primary Examiner*—Milton I. Cano
*Assistant Examiner*—Robert Madsen
(74) *Attorney, Agent, or Firm*—Flanagan & Flanagan; John R. Flanagan

(57) ABSTRACT

Food packaging for packaging a food item in separate layers. The package includes a retaining member with openings to receive separating sheets between layers of food Separating sheets are removed while retaining layers of the food item from moving, just prior to consumption. The food is retained in layers in a box like enclosure integrally including the container.

18 Claims, 12 Drawing Sheets

Fig. 1
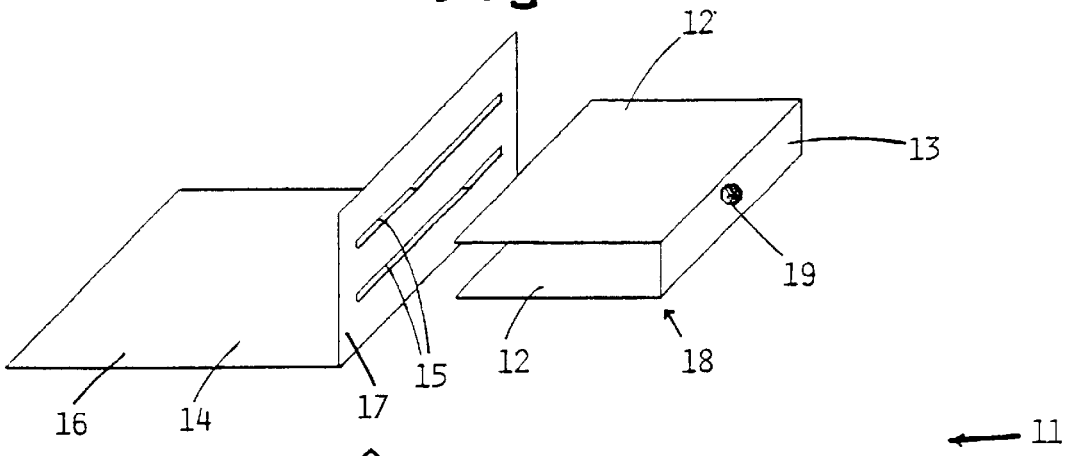
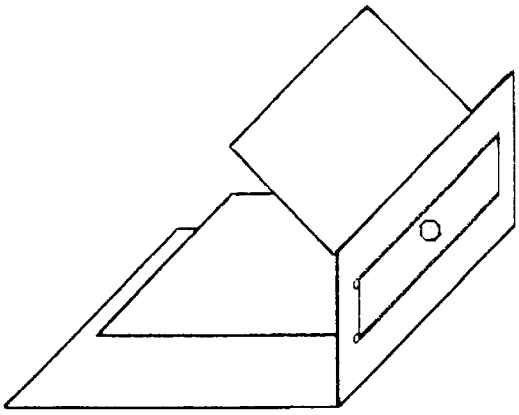
Fig. 2

FOOD PACKAGING DEVICE FOR MULTILAYER FOOD ITEMS IN SEPARATE LAYERS

This application is the National Stage of International Application No. PCT/AU98/00965 filed Nov. 19, 1998.

TECHNICAL FIELD

This invention relates to a food packaging for packaging and transporting of food items in separated layers. It is particularly relevant to packaging and transport of sandwiches but is not limited to that application. Other uses can include for crisp bread, biscuits, bread rolls and other food items having layers such as trifles and puddings or requiring initial separation.

BACKGROUND ART

There are many forms of packaging of a sandwich as a whole such as in vertically slotted lunch boxes receiving whole sandwiches in the slot and drinks or fruit in other slots. Sandwiches can be firmly wrapped within a thin wrapping material such as a polyethylene wrap. Also packaging can be in triangular halves with an L-shape cardboard structure running alongside the outside L-shape of the crust of a diagonally cut sandwich, with the sandwich being fully enclosed by a thin wrap so that the contents of the sandwich are visible through the thin wrap along the diagonal of the sandwich.

However, all these forms of packaging and transport of sandwiches provide protection around the entire outside of the sandwich but allow for permeation of various materials of the sandwich through to other parts of the sandwich.

In particular it is very difficult to package and transport salad sandwiches which may incorporate a number of liquid holding materials such as lettuce, beetroot, tomato; a range of differently compressible materials such as crispy lettuce and sliced cheese; and a range of liquid permeable materials such as grated carrot and the bread itself. Also some foods may have strong flavours or odours, such as eggs or fish, which are able to permeate other parts of the sandwich. Generally, if a fresh salad sandwich is made and eaten soon after making, the full benefit of this collection of flavours and consistency is enjoyed since there has not been time for substantial permeation, deterioration or deformation of the sandwich. However, if a sandwich is made in the morning and transported to work or school and eaten some three to six hours later, permeation, deterioration and deformation of the various liquids, flavours and odours of the constituents result in a less palatable sandwich. Similar loss of palatability occurs, but possibly at a slower rate, for crisp bread or biscuits with toppings whether that be cheese spread, food pastes or other. Even further lessening of palatability occurs with prepackaged commercial material which may not be consumed until days, weeks or months after manufacture.

The three options usually taken to overcome such problems with regard to sandwiches is to firstly not make salad sandwiches or other sandwiches likely to allow such permeation or deterioration if the sandwich is not being eaten immediately. Secondly, allow controlled permeation by the particular arrangement of the materials in the sandwich such that for example, beetroot is placed between a cheese slice and the grated carrot so that any liquid is absorbed by the grated carrot on one side and only partially permeates the cheese slice on the other side. Thirdly, purchase a commercial sandwich when required which has been freshly made, thereby increasing costs. Other commercial products would include additives to repel or retain moisture or to retain freshness of particular constituents. The ever increasing number of additives in foods is becoming less acceptable to consumers or is detrimental to the health of some consumers.

It is known to have a container which has separate compartments. For example, U.S. Pat. No. 4,595,099 shows a particular container for ice cream sandwiches. This allows for multiple numbers of ice cream sandwiches to be included in a container set. When it is desired to consume one of the separated and stored sandwiches it may be easily extracted from the container by, after removing the cover, pushing up on an insert disc through an aperture in the bottom of the container with the thumb or forefinger. However, such an apparatus does not maintain the layers of the food separate. As such, it is necessary to have a biscuit end which is substantially impermeable to the ice cream, or allow for permeation or sogginess of the biscuit.

It is also known to separate layers of food such as layers of cheese that readily stick together. As shown in UK patent GB 2192170 this is undertaken by having a strip of material extending in zigzag formation throughout the layers of cheese and ensuring a double layer of strip material between the layers of cheese. In this way it is the non-adhesiveness of the double layer to each other which allows removal of a single layer of food. However, it is not possible to use such a system for layers of food which allows removal of the system while retaining the food in the same layer formation.

It is an object of this invention to provide a food packaging that allows for easy packaging and transport of the food item so as to avoid or minimise the disadvantages provided by permeation and crushing of constituents of the sandwich.

DISCLOSURE OF THE INVENTION

In accordance with the invention there is provided a food packaging for use in packaging a food item in separate layers, including: one or more separating sheets for placement between layers of food items to be retained separate for a period of time; a retainer with one or more openings sized to allow a substantial portion of one or more of said separating sheets placed between layers of food items to extend therethrough so as to allow removal of said one or more separating sheets through the openings while retaining the layers of the food item from substantially moving with the separating sheets.

The separating sheets may be flexible or rigid and the retainer may be positioned when in use at substantially right angles to the separating sheets along one side of the food item with its openings being slots to allow for lateral removal of the separating sheets which have been positioned substantially parallel to the base of the food item.

The layered and separated food item may be enclosed by an enclosure means. This can be a rigid structure which cooperates with the larger retainer means or be a flexible wrapping material such as polyethylene wrap or wax paper.

The food packaging may include a spacing means to maintain the separating sheets in relative spaced positions so as to avoid crushing of the layers of food items. The retainer and/or enclosure means can form part of the spacing means.

In one form the invention comprises a food packaging for packaging a food item with separated layers, including: one or more separating sheets for placement between layers of food items to be separated; an enclosure means able to substantially surround the food product, spacing means able to maintain the separating sheets in relative spaced positions, and a retainer able to extend substantially perpendicular to said one or more separating sheets and with one or more openings sized to allow said one or more separating sheets to be placed between layers of food items and to extend therethrough and allow removal of said one or more separating sheets through the opening while the retainer prevents the food item from substantially moving with the separating sheets.

The invention also provides a method of packaging a layered food item which is selectively separated while being retained as a layered food item including the steps of:

constructing a layered food item with separating sheets placed between the layers to be selectively kept separate; enclosing the layered food item; and wherein removal of the separating sheets comprises the step of: providing a layer retaining means along a side of the food item and having an opening sized to allow lateral removal of one or more of the separating sheets substantially through the opening while retaining the food item in layers.

The separating sheets may be positioned substantially parallel to the base of the food item. The method may include using a spacing means to maintain the separating sheets in relative spaced positions so as to avoid crushing of the layers of food items.

BRIEF DESCRIPTION OF THE DRAWINGS

In order that the invention is more readily understood, various embodiments of the invention are described with reference to the drawings wherein:

FIG. 1 is a perspective view of a food packaging in accordance with a first embodiment of the invention with its two constituent parts separate.

FIG. 2 is a perspective view of the food packaging of FIG. 1 with the two constituent parts fitting together.

MODES FOR CARRYING OUT THE INVENTION

Figure 3:
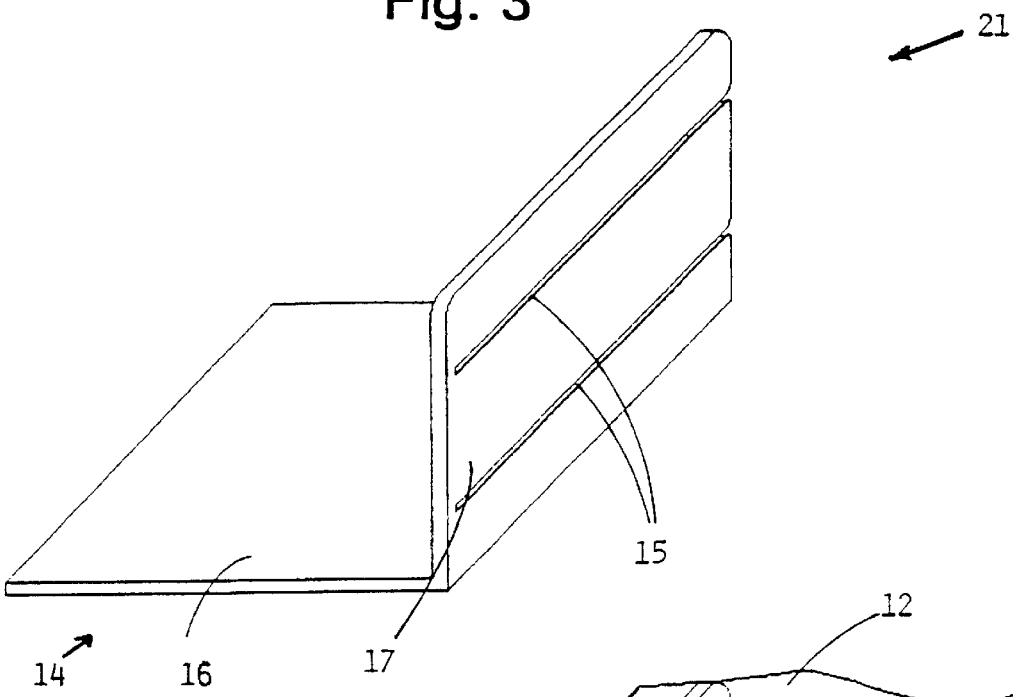
FIG. 3 is a perspective view of a food packaging in accordance with a second embodiment of the invention.

Referring to the drawings there is shown a food packaging 11 of a first embodiment having an L-shaped retainer 14 and U-shaped spacing means 18. Two spaced planar separating sheets 12 form the legs of the U-shaped spacing means 18 and is sized to be insertable through openings 15 being longitudinal thin slots in an upright side 17 of the L-shape retainer 14. The L-shape body of the retainer 14 is substantially rigid when made of rigid plastics or less rigid when made of cardboard which has been bent into the L-shape. The L-shape body 14 has a base 16 which is substantially the size of a slice of bread such that a layered sandwich can be made on top of the base 16 with the upright side 17 of the L-shape body 14 extending upwards along the side of the sandwich. The slots 15 extend parallel along most of the length of the upright side 17 of the L-shape body 14 and are spaced so as to provide suitable distance between the separating sheets 12 when inserted. This allows required separation for various layers of the food items. A connecting part 13 between the legs 12 of the U-shaped spacing means 18 includes a knob 19 to allow easy retraction of the spacing means 18 from the L-shape retainer 14.

In use the L-shape retainer 14 is placed on a flat surface and a buttered piece of bread is placed face up on the base 16 of the L-shape body 14 so as to be fully within the perimeter of the base. The U-shape spacing means 18 is inserted through the slots 15 in the upright side 17 of the retainer 14 such that the lower separating sheet 12 forming one leg of the U-shape spacing means 18 becomes a layer separator between the buttered bread and the material such as salad material to be included on top. The upper separating sheet 12 forming the other leg of the U-shape spacing means 18 is placed over the salad material and another buttered piece of bread is placed face down on top of the upper separating sheet 12. The entire sandwich and the L-shaped retainer 14 and separating sheets 12 are enclosed by an enclosure means (not shown) such as a polyethylene wrap to provide a means of packaging and transporting a sandwich such as a salad sandwich while retaining the layers of the bread and salad separate and by preventing permeation, deterioration or deformation of the salad material into the bread. When required the polyethylene wrap forming the enclosure means can be removed and the knob 19 of the U-shape spacing means 18 held and withdrawn laterally such that the separating sheets 12 are able to slide out through the slots 15 of the upright part of the L-shape retainer 14 while the remainder of the upright side 17 of the retainer 14 retains the sandwich within the confines of the base 16 thereby providing, after completion of removal of the separating sheets 12, a layered sandwich that can be eaten forthwith.

Figure 4:
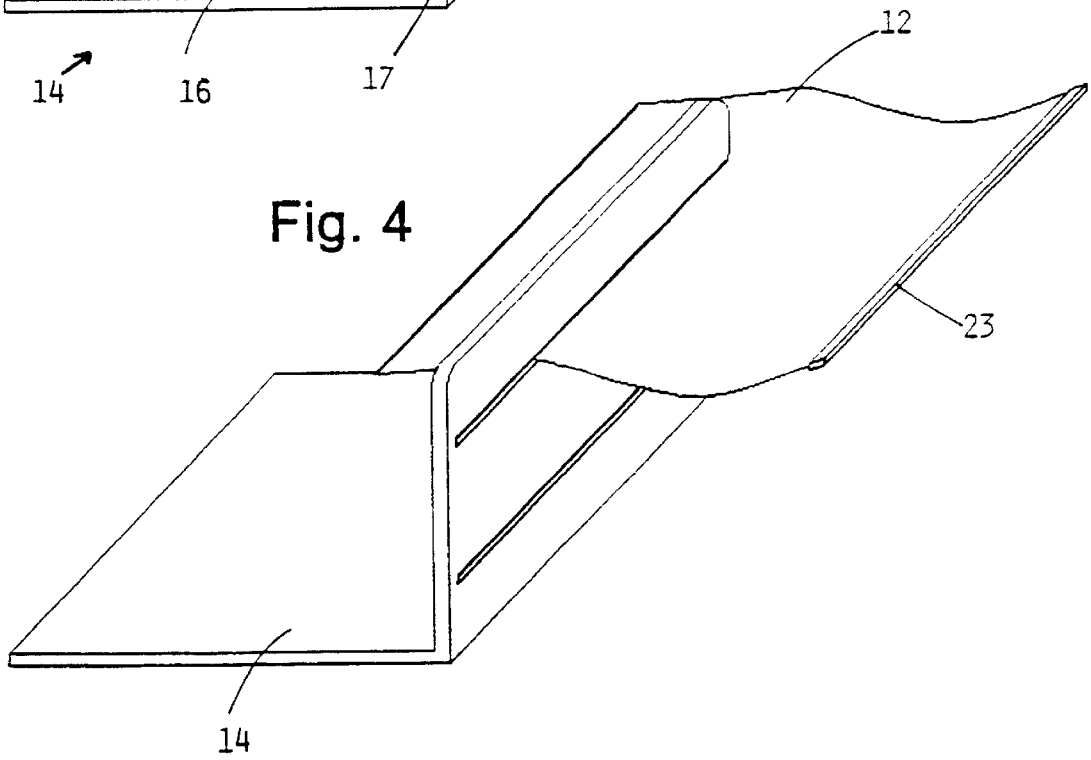
FIG. 4 is a perspective view of the food packaging of FIG. 3.

A second embodiment 21 of the invention shown in FIGS. 3 and 4 includes a rigid L-shaped body 14 forming the retainer but having elongated open ended slots 15 which extend from near one end to the other end of the upright side 17 of the L-shape retainer body 14. The separating sheets 12 can be of a larger size than the base 16 of the L-shape body 14 and can be flexible sheeting such as wax paper. Each of the separating sheets 12 has an edging 23 extending along one side which is sized so as to prevent passage of the entire separating sheet 12 through the slots 15 of the upright of the L-shape body 14 and provides a gripping surface for withdrawal of the separating sheets 12.

Figure 5:
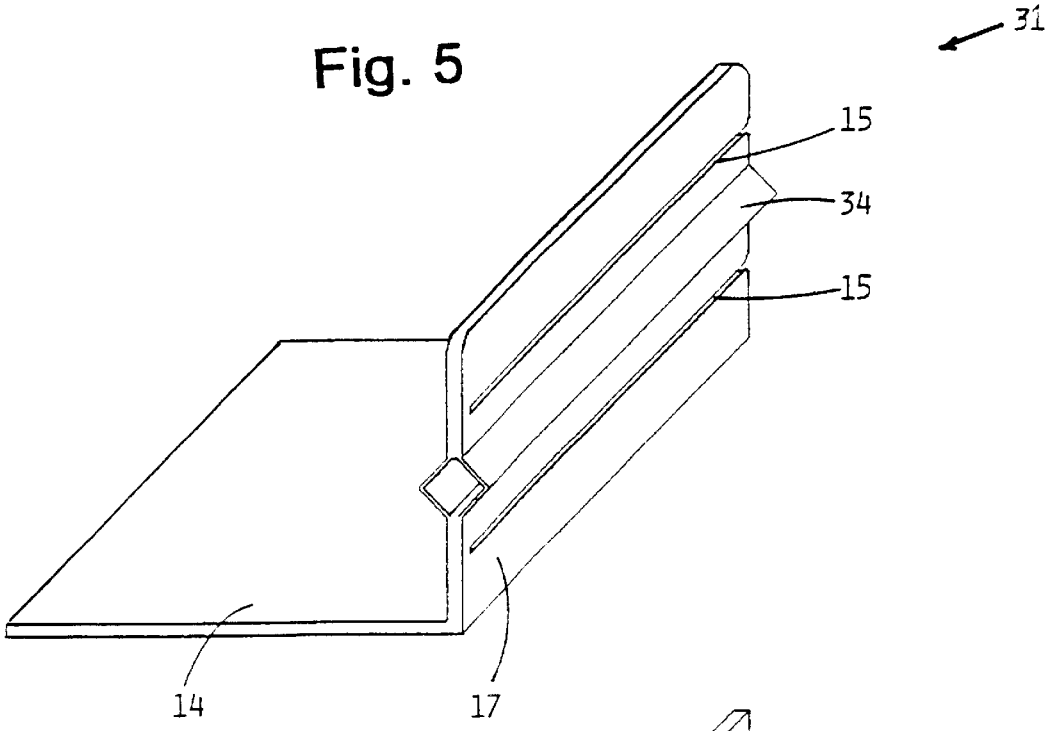
FIG. 5 is a perspective view of a food packaging in accordance with a third embodiment of the invention.

A third embodiment 31 of the invention is shown in FIG. 5 and includes two spaced open ended elongated parallel slots 15 extending to the end of the upright side 17 of the L-shape retainer body 14. However, positioned between the slots 15 in the upright side 17 is a compressible wall part 34 extending the entire length of the upright side 17. This compressible wall part 34 comprises a bendable material having a diamond cross section with upper, lower and lateral vertices such that applying compressive forces to the upper and lower vertices of the compressible wall part 34 joined to upper and lower parts of the upright part of the L-shape retainer body 14 causes the compressible wall part 34 to bend at the lateral vertices to thereby decrease the spacing between the upper and lower vertices and thereby decrease the spacing between the slots 15 in the upright part of the body 14.

In use the food packaging 31 having a compressible wall part 34 allows for variable spacing between the separating sheets 12 to allow for variability of the sizing of the layers of the food item to be separated.

Figure 6:
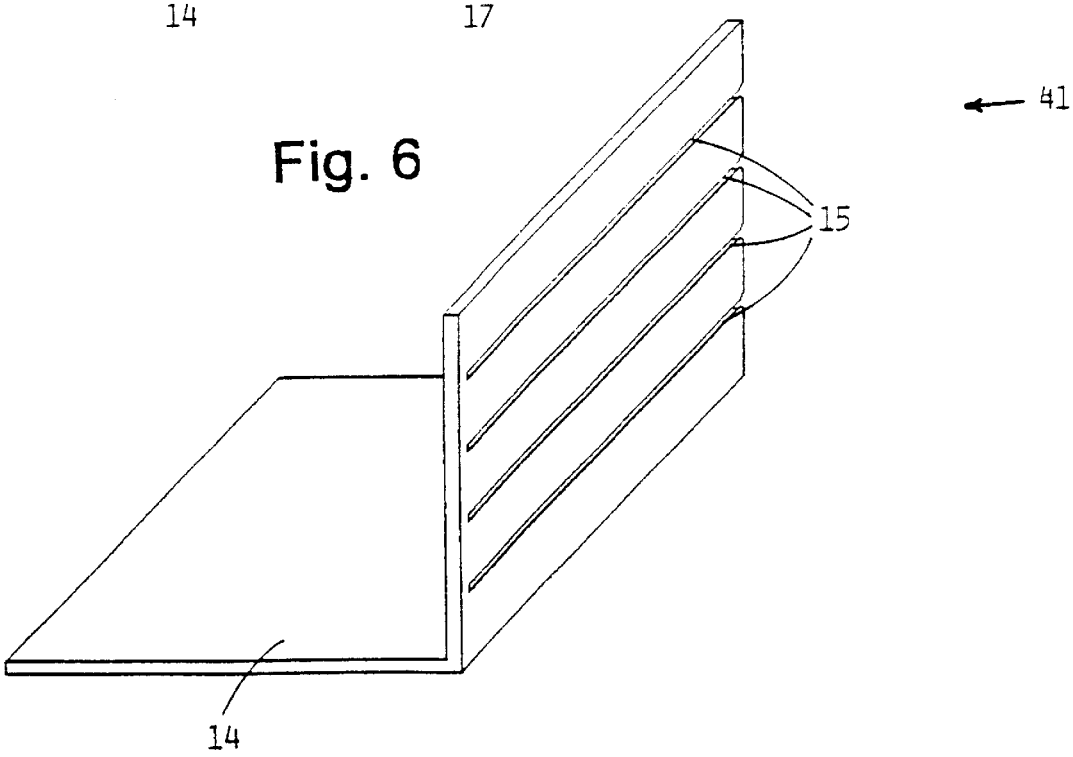
FIG. 6 is a perspective view of a food packaging in accordance with a fourth embodiment of the invention.

Another embodiment of the food packaging of the invention 41 shown in FIG. 6 allowing variability of the spacing of the separating sheets 12 has an L-shaped retainer 14 with a upright wall 17 with plurality of spaced elongated open ended longitudinal slots 15 extending parallel to each other and to the base 16 of the L-shape body 14 and providing a choice of positions for the separating sheets 12 to be inserted. In this way the L-shape retainer 14 also performs the function of a spacing means 18. If required four separating sheets 12 could be inserted into four coextensive slots 15 or one, two or three separating sheets 12 could be placed in the required slots 15 to allow the required dimension of the layer to be separated.

Figure 7:
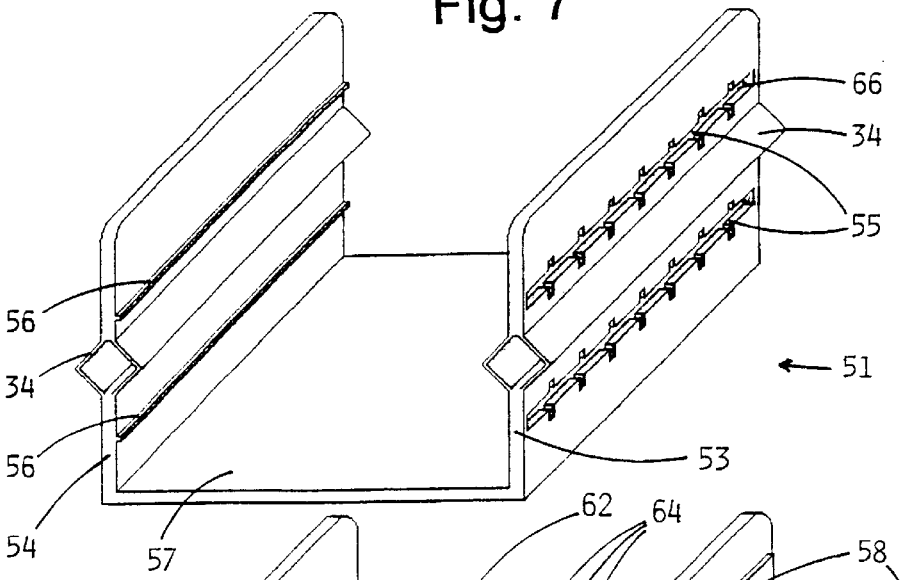
FIGS. 7, 8 and 9 are perspective views of a food packaging in accordance with a fifth embodiment of the invention.
Figure 8:
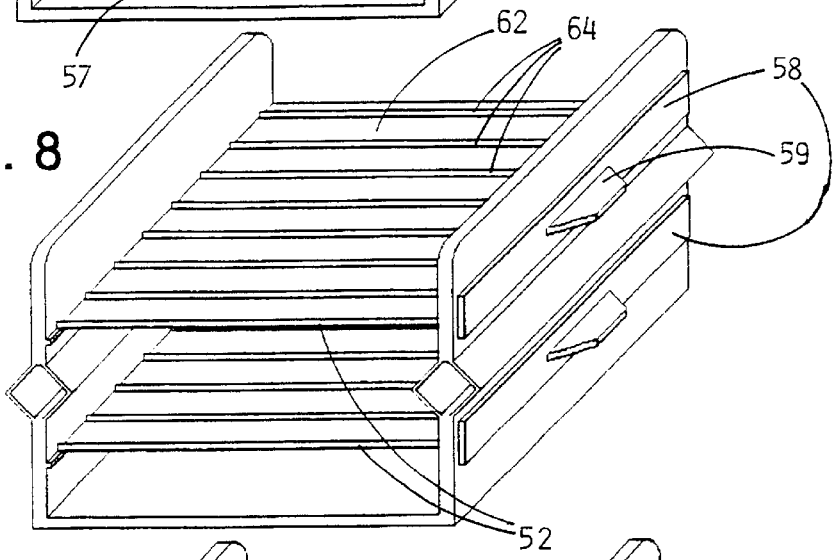
Figure 9:
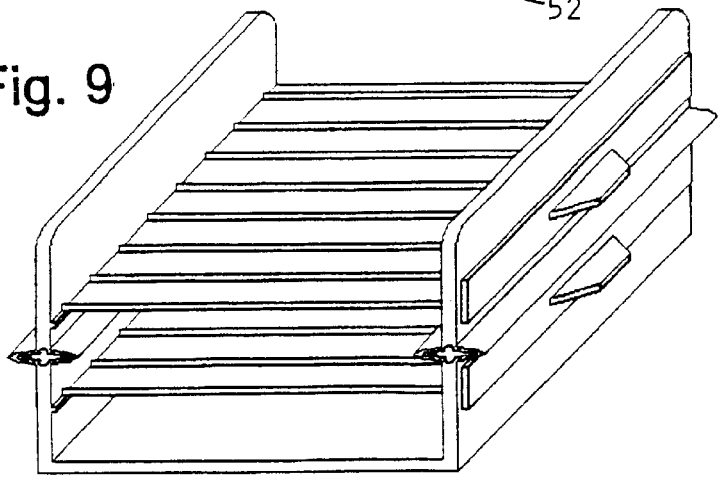
Figure 10:
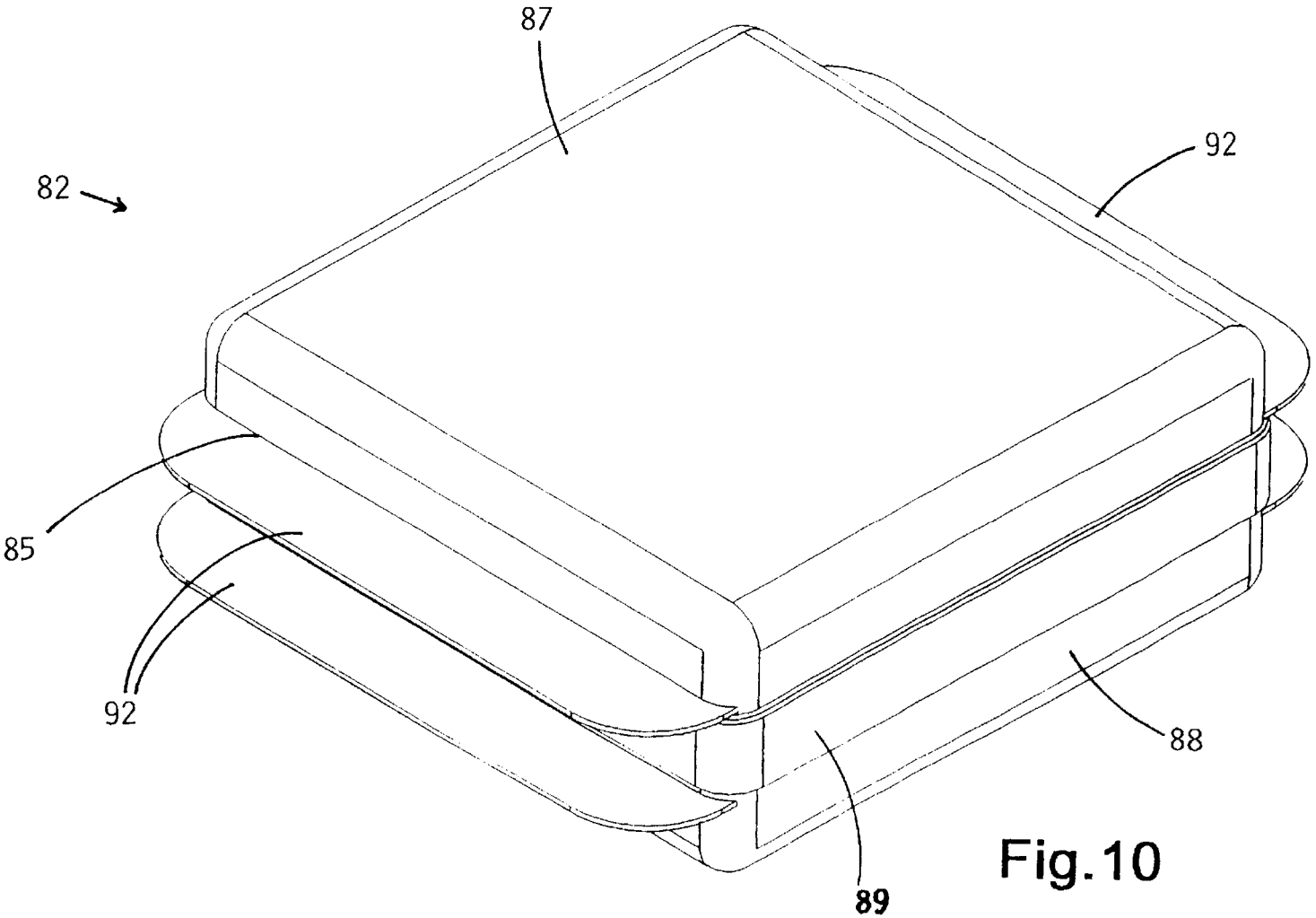
FIG. 10 is an isometric view of a food packaging in accordance with a sixth embodiment of the invention.
Figure 11:
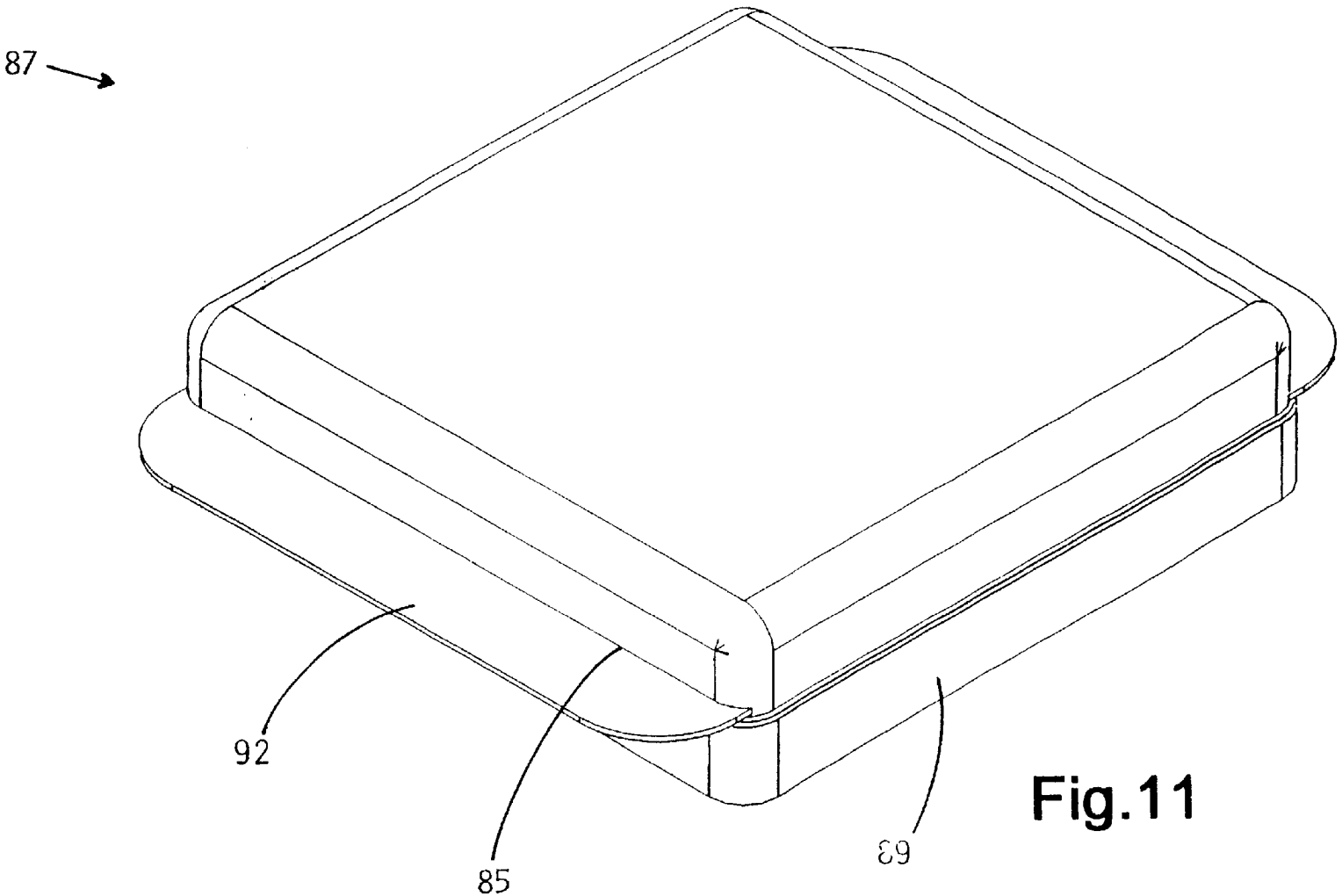
FIG. 11 is an isometric view of a top portion of the food packaging of FIG. 10.
Figure 12:
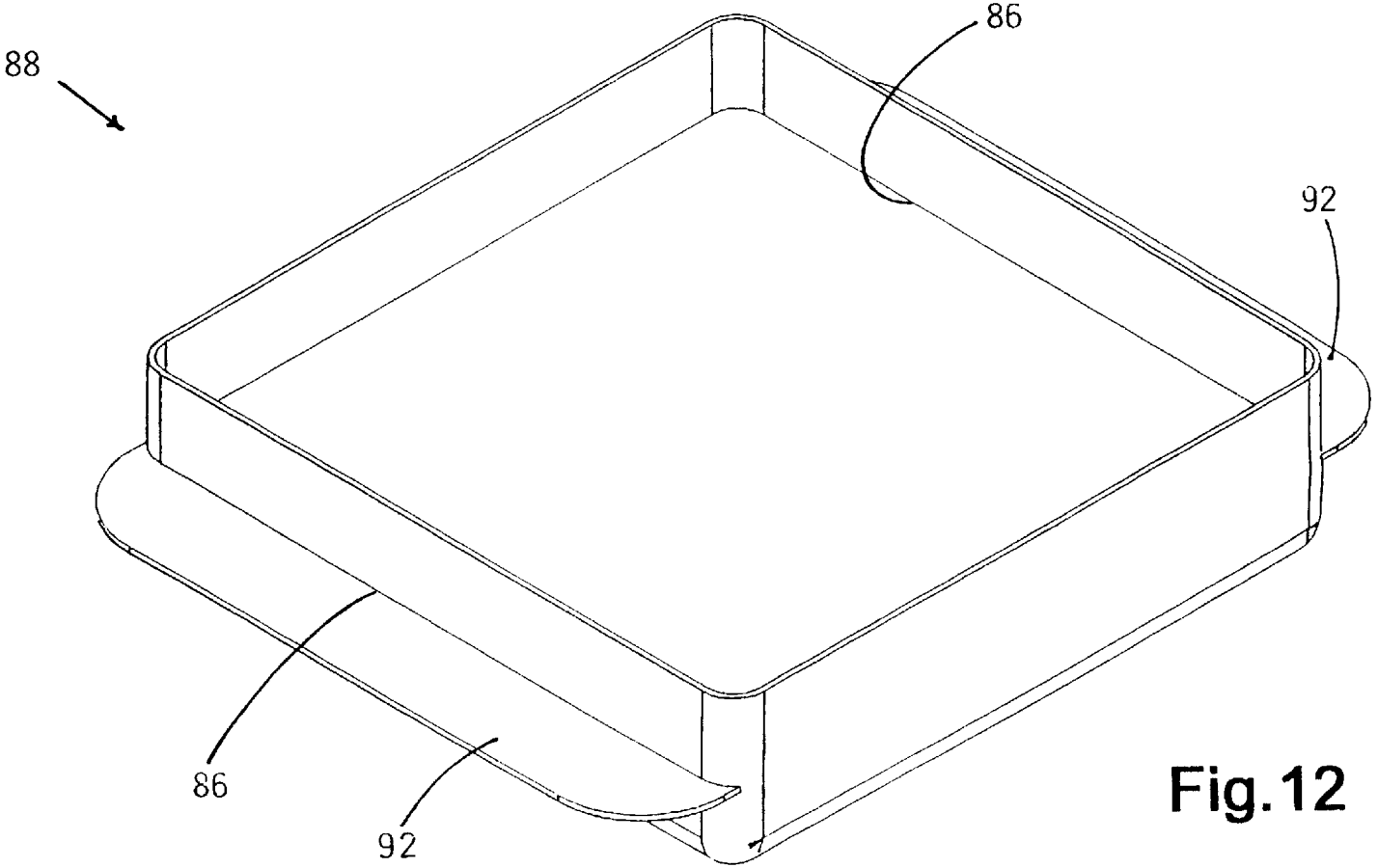
FIG. 12 is an isometric view of a base portion of the food packaging of FIG. 10.
Figure 13:
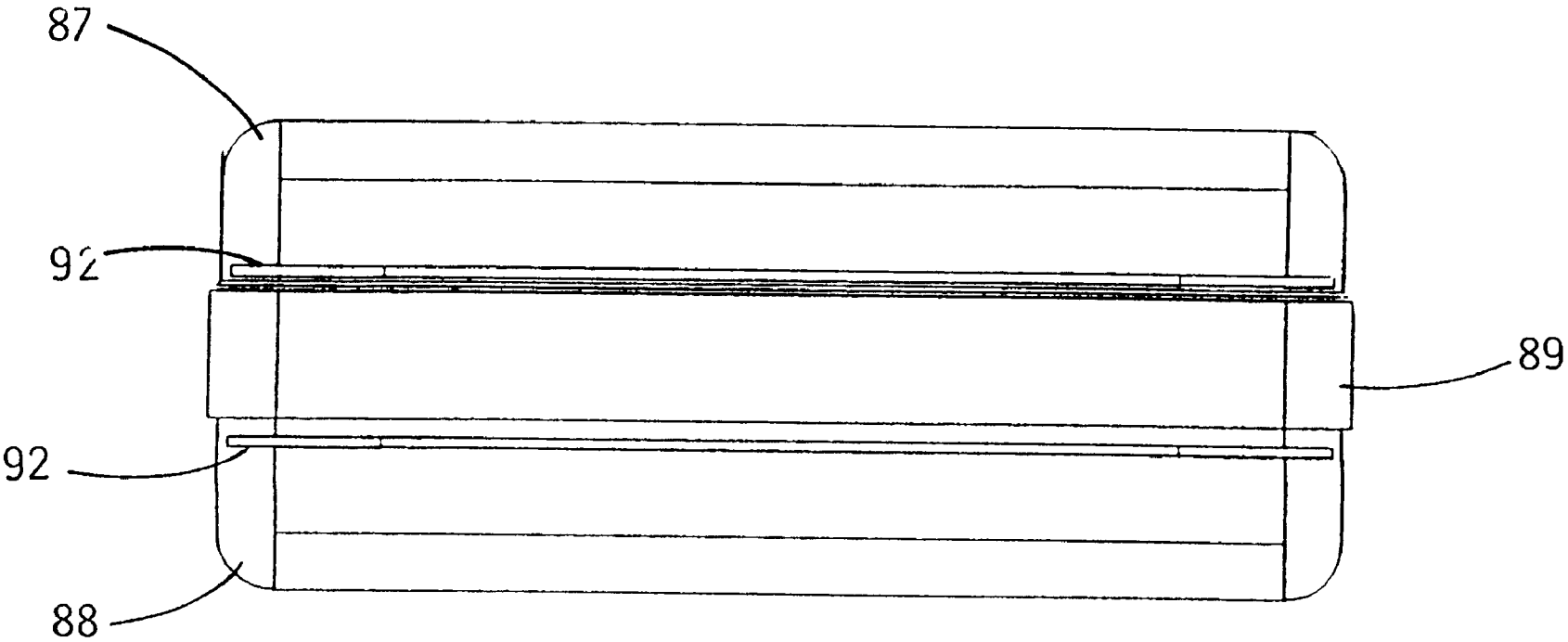
FIG. 13 is an end view of the food packaging of FIG. 10.
Figure 14:
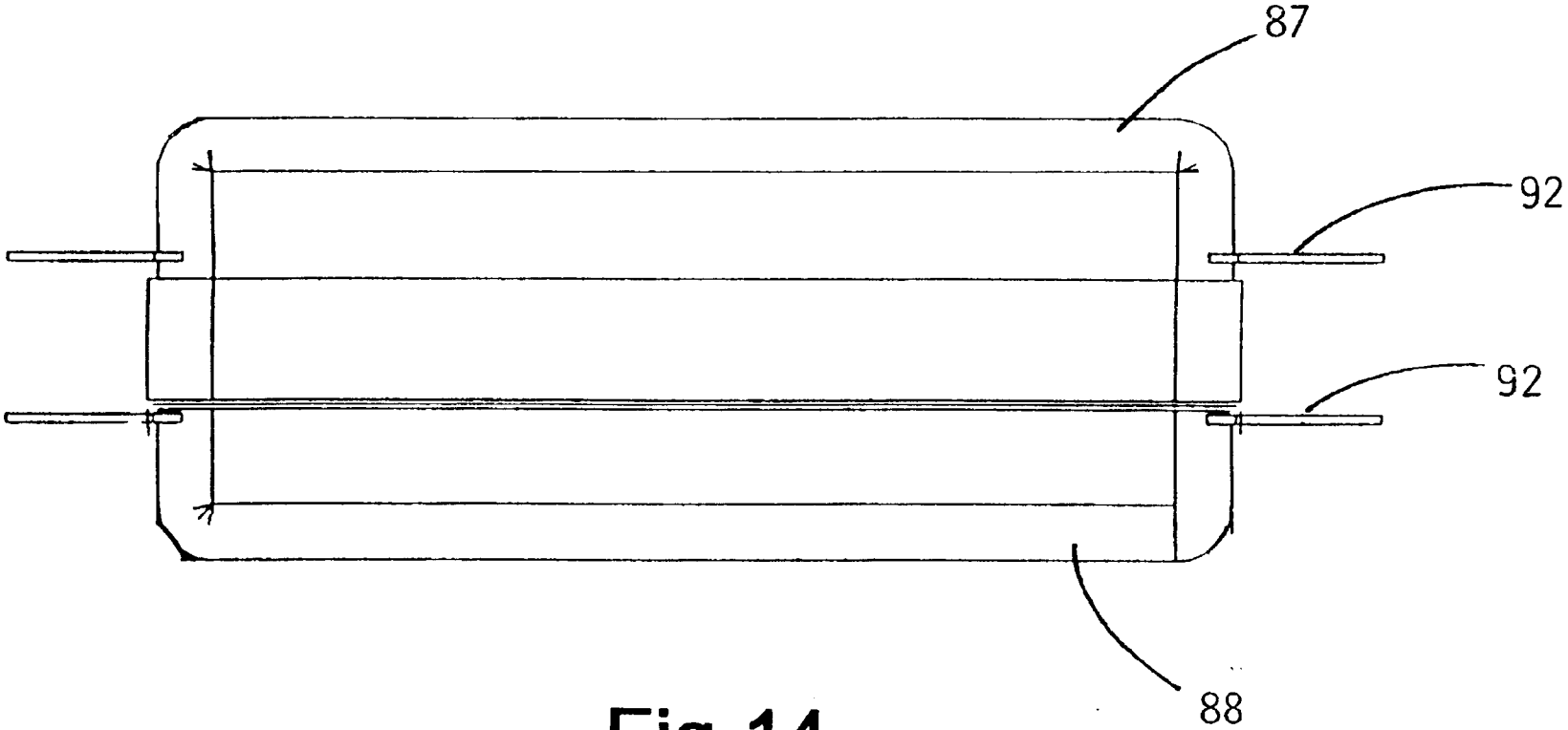
FIG. 14 is a side view of the food packaging of FIG. 10.
Figure 15:
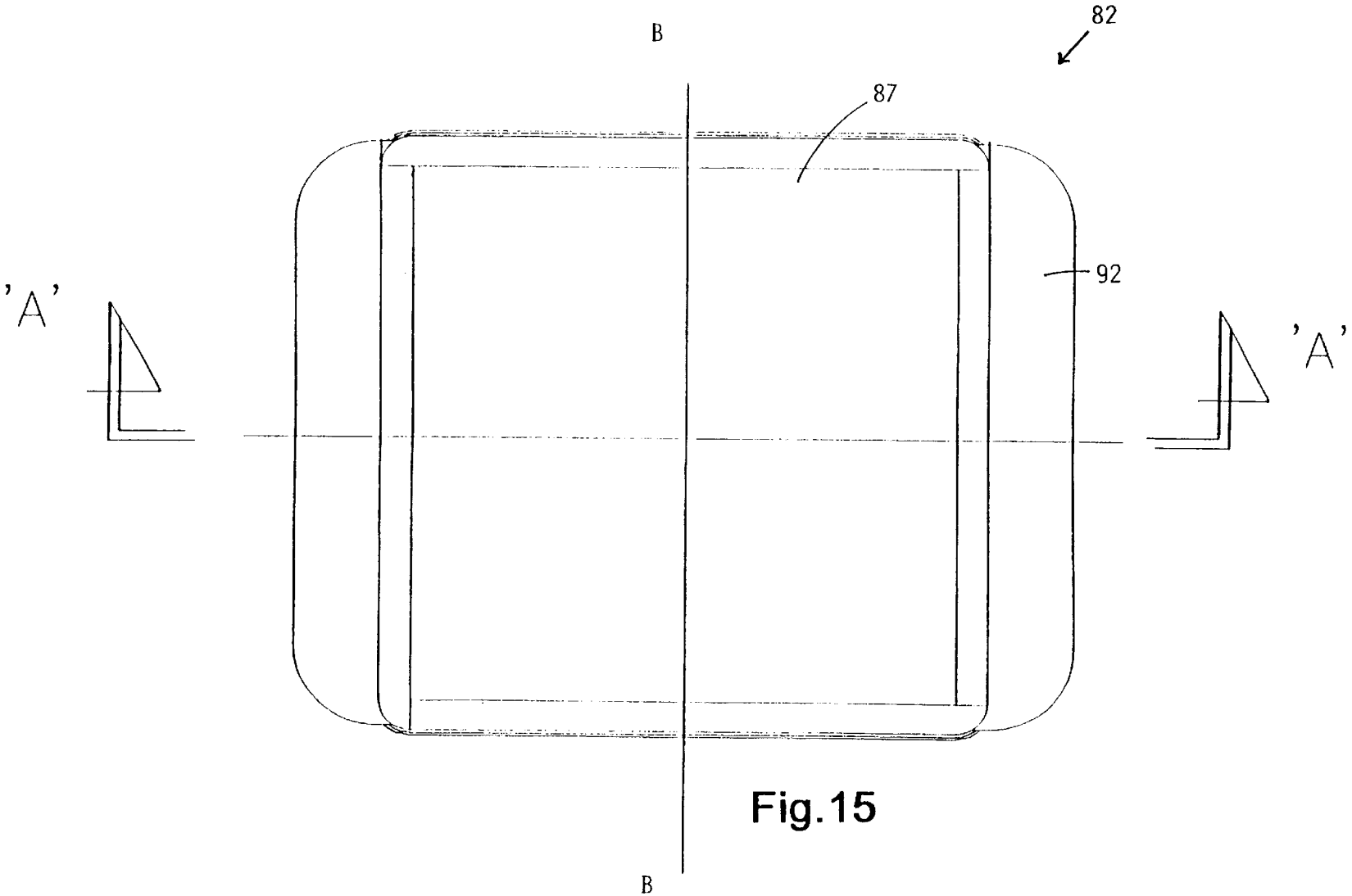
FIG. 15 is an overhead plan view of the food packaging of FIG. 10.
Figure 16:
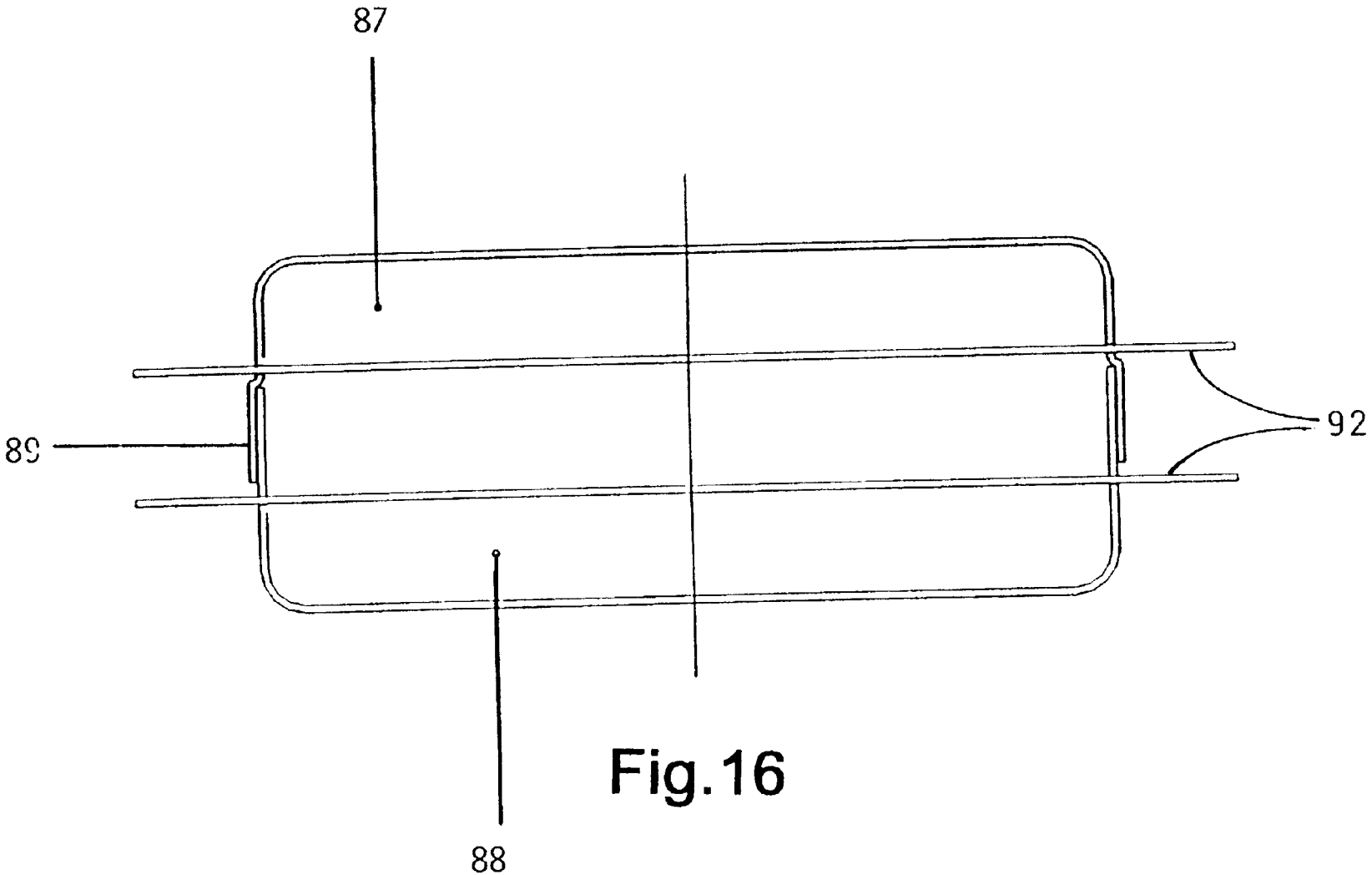
FIG. 16 is a vertical cross section along the lines A—A of FIG. 15.
Figure 17:
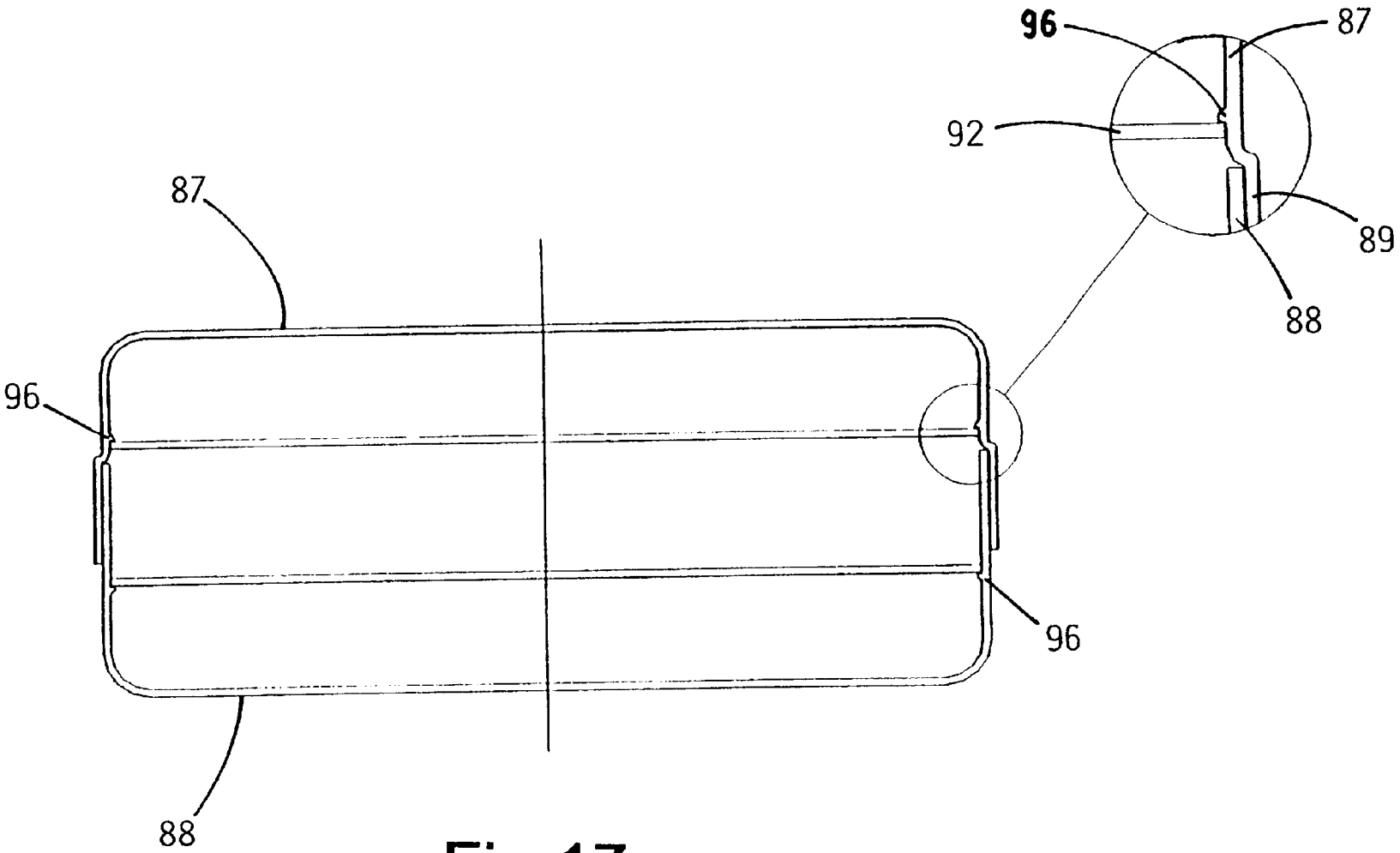
FIG. 17 is a vertical cross section along the line of B—B of the food packaging of FIG. 15.

A further embodiment of the invention comprises a food packaging as shown in FIGS. 7, 8 and 9 includes two separating sheets 52 inserted in two side spaced longitudinal slots 55 of a U-shaped retainer 51. In this form of the food packaging of the invention is included a more elaborate spacing means integral with the U-shaped retainer 51 for maintaining the entire separating sheets 52 at spaced intervals. The spacing means is performed by the upright legs of the U-shape retainer 51 with one leg 53 having the elongated slots 55 extending parallel to the base 57 of the U-shape and with ledges 56 on the inside of the other leg 54 of the U-shape retainer 51 in a position adjacent the corresponding height of the slots 55 on the first leg so as to support the rigid separating sheets 52 parallel to the base 57 of U-shape spacing means 57. The legs 53, 54 of the U-shape spacing means 51 also include compressible wall parts 34 extending the entire length between the slots 15 and ledges 56 respectively such that the relative spacing between the separating sheets 52 can be altered as required.

The separating sheets 52 further include upstanding ridges 64 extending parallel along their lengths from flat surface 62 and on both sides of the separating sheets 52 but offset. The elongated side slots 55 of the U-shaped retainer 51 have corresponding vertical extending notches to allow the ribbed separating sheets 52 to be inserted through the slots 55 and rest on the ledge 56 on the inner side of the other side 54 of the retainer 51. The upstanding edges 64 forming the ribbing provide a minimal contact surface with the food positioned adjacently so as to allow easy insertion and removal of the separating sheets 52 while retaining the food in position and in its layered format. The end of the separating sheets 52 have an orthogonal end piece 58 which substantially closes the elongated slots 55 and includes a handle 59 on the outer side to allow easy removal of the separating sheet 52 through the elongated slot 55.

In use the whole apparatus can be enclosed by a thin polyethylene wrap. The wrap can be applied with some tension so that the compressible wall parts 34 are compressed such as shown in FIG. 9 to provide a compact transportable layered and separated sandwich. The compressible wall parts 34 can include some resilience such that when the polyethylene wrap is removed the compressible wall parts 34 spring apart so as to allow further spacing between the separating sheets 52 and allow easy removal of the separating sheets 52.

Referring to the embodiment shown in FIGS. 10 to 17, there is a box-like enclosure means 82 which includes integrally the retainer and spacing means and which is able to receive through end slots 85, 86 planar separating sheets 92 that protrude out corresponding sized and height longitudinal slots 85, 86 at the opposite end while fitting between the sides of the enclosure means 82.

The enclosure means 82 includes two parts being a top 87 that interfits over a base 88 so as to form the sealed enclosure means that can enclose a sandwich, roll, biscuit or the like. The top 87, therefore, has a flat dimension at least the size of bread or biscuit material to form the outer layers and spacing within the top 87 above the elongated slots 85, 86 receiving the separating sheet 92 extending across the enclosure means 82 so as to substantially enclose the bread or biscuit material in a separate compartment. A peripheral flange or skirt 89 extends along the entire circumference of the lower edge of top 87 below the slot able to receive the separating sheet 92. This flange 88 extends substantially perpendicular to the slot 92 with a diametrical size larger than the diameter of the base 88 so as to be able to interfit over the base 88 above the slot 86 of the base 88. In this way a second compartment is formed between the separating sheets 92 fitting into the slots 85, 86 of the top and bottom 87, 88 so as to be able to receive a salad or other sandwich filling therebetween. Similar to the top 87, the base 88 includes a further compartment below the separating sheet 92 inserted into the slot 85 of the base 88 which is able to receive a second piece of bread to complete the sandwich. Longitudinal ridges 96 extending along the internal sides of the top 87 and bottom 88 between ends having the slots 85, 86 provide a positional guide for the separating sheets 92 when inserted into the slots, 85, 86.

In use, a piece of bread is buttered and placed upright in the base 88 prior to insertion of a separating sheet 92 into the slot 86 of the base 88. By insertion of the separating sheet 92 the bottom buttered bread is completely separated from other materials. Upon this separating sheet 92 covering the entire inside of the base 88 is inserted the sandwich fillings. A buttered piece of bread is inserted into the compartment of the top 87 and separated from the other material by insertion of the separating sheet 92 into the slot 85 of the top 87. The top 87 is placed over and interfits with the base 88 to form a substantially sealed closure means 82 which fully encloses the sandwich while retaining the layers of food separated. If required, the enclosure means 82 may include a number of separating sheets 92 such that particular layers of filling may be separated.

When the sandwich is required the separating sheets 92 are removed from the enclosure means 82 through the slots 85, 86 while the top and bottom 87, 88 are still interfitted such that the walls of the top and bottom 87, 88 retain the materials within the enclosure means. After full removal of the separating sheets 92 the top 87 is removed from the base 88 revealing a sandwich which has only recently had the contents of the filling engaging the bread surface and therefore allowing minimal permeation of the materials and simulating a freshly made sandwich.

It should be evident from the description hereinabove that the present invention provides an improved food packaging which avoids most if not all the disadvantages of the prior art. Of course, many modifications of described embodiments may be readily envisaged by a person skilled in the art and are included in the scope of this invention. In particular the packaging can be of a material able to be microwaved or heated in an oven. Also the packaging means may relate to open top biscuits rather than sandwiches. It also may be used for puddings or other foods where a particular timed amount of permeation of adjacent layers is required.

What is claimed is:

1. A food package for use in packaging a multi-layer food item in separate layers, including:

a container having at least one enclosing wall part forming an internal surrounded cavity and one opening for allowing the multi-layer food item contained therein to be placed in horizontal layers;

a plurality of separating sheets for spaced placement between layers of the food item to be retained separate for a period of time;

a retainer with a plurality of openings sized to allow a substantial portion of said separating sheets to extend therethrough into the cavity; and a spacing means for maintaining the separating sheets in relative spaced positions so the separating sheets are able to be placed between layers of the food items and allow removal of said separating sheets through the retainer openings while retaining the multi-layers of the food item substantially in layers in the container, said one opening of said container allowing removal of the multi-layer food item as a whole.

2. A food packaging as defined in claim 1 wherein the retainer is planar with slit openings spaced from the opening and shaped and sized to be able to receive said one or more separating sheets.

3. A food packaging as defined in claim 2 wherein the retainer is formed by a side wall of the container.

4. A food packaging as defined in claim 1 wherein the separating sheets are flexible and the food packaging is reusable.

5. A food packaging as defined in claim 1 wherein the separating sheets are planar.

6. A food packaging as defined in claim 1 wherein the spacing means includes expandable portions to provide a selectable spacing between layers in separating and unseparating positions.

7. A food packaging as defined in claim 1 wherein the separating sheets are integral with at least one part of the spacing means.

8. A food packaging as defined in claim 1 wherein the separating sheets are substantially planar and include a ridge at or near one end sized to prevent complete insertion of the separating sheets through the opening and aid removal of the one or more separating sheets through the opening.

9. A food packaging as defined in claim 1 wherein one or more of the separating sheets are substantially planar and spaced overlying each other and connected together at one common end.

10. A food packaging as defined in claim 1 wherein the food item may be enclosed by an enclosure means for surrounding the food item having a fixed top, a fixed bottom, and an enclosing wall part.

11. A food packaging as defined in claim 10 wherein at least a part of the enclosure means is integral with a spacing means able to maintain the separating sheets in relative spaced position.

12. A portable food package for packaging a multi-layered food item with separated layers, including:

an enclosure means for surrounding the food item having a fixed top, a fixed bottom, and an enclosing wall part;

a plurality of separating sheets for replaceable placement between horizontal layers of the food item to be separated, the enclosing wall part forming a spacing means for maintaining the separating sheets in relative spaced positions; and a retainer extending substantially perpendicular to said plurality of separating sheets, having a plurality of openings sized to allow placement of said plurality of separating sheets in spaced positions between layers of the food item and extending therethrough, and preventing the layers of the food item from moving with the separating sheets sheets when the separating sheets are removed through the openings to allow vertical removal of the food item in a unitary layered form.

13. A food packaging as defined in claim 12 wherein the enclosure means is box shaped having a base and upstanding walls and the retainer and spacing means is formed by at least one of said walls having spaced elongated slots sized to allow a portion of the separating sheets to be inserted therethrough and to be removed therefrom while the slot free portion of the retainer wall retains the food product within the enclosure means and allows the multi-layered food item to be withdrawn as a whole.

14. A food packaging as defined in claim 13 wherein the elongated slots of the retainer wall are spaced equidistantly along their lengths.

15. A food packaging as defined in claim 12 wherein the enclosure means includes internal ridges or protrusions to form part of the spacing means to space the separating sheets in the enclosure means.

16. Separating sheets for food packaging as defined in claim 12.

17. A method of packaging a layered food item which is selectively separated while being retained as a layered food item, including the steps of:

enclosing the layered food item by an enclosure wall part and fixed top and bottom while separating the layered food item with a plurality of separating sheets placed between the layers to be selectively kept separate; providing a plurality of slots in the enclosure wall part to maintain the separating sheets in relative spaced positions so as to avoid crushing of the layer of food items;

and removing one or more of the separating sheets substantially through the plurality of slots while retaining the food items in layers.

18. A method of packaging a layered food item as defined in claim 17 wherein the separating sheets are positioned substantially parallel to the base of the food item.

* * * * *